US006932250B2

(12) United States Patent
Bederka

(10) Patent No.: US 6,932,250 B2
(45) Date of Patent: Aug. 23, 2005

(54) SUBMERGED ENTRY NOZZLE AND METHOD FOR MAINTAINING A QUIET CASTING MOLD

(75) Inventor: Daniel J. Bederka, Baltimore, MD (US)

(73) Assignee: ISG Technologies Inc., Richfield, OH (US)

( * ) Notice: Subject to any disclaimer, the term of this patent is extended or adjusted under 35 U.S.C. 154(b) by 164 days.

(21) Appl. No.: 10/367,518

(22) Filed: Feb. 14, 2003

(65) Prior Publication Data

US 2004/0159987 A1 Aug. 19, 2004

(51) Int. Cl.[7] ..... B22D 41/08
(52) U.S. Cl. ..... 222/606; 222/594; 164/437
(58) Field of Search ..... 222/591, 594, 222/606; 164/437

(56) References Cited

U.S. PATENT DOCUMENTS

| | | | |
|---|---|---|---|
| 3,587,719 A | 6/1971 | Duisburg et al. | |
| 3,648,761 A | 3/1972 | Speith et al. | |
| 4,108,339 A | 8/1978 | Lunde | |
| 4,423,833 A | 1/1984 | Richter et al. | |
| 4,487,251 A | 12/1984 | Cahoon et al. | |
| 4,819,840 A | 4/1989 | Lax et al. | |
| 4,858,794 A | 8/1989 | Sugiura et al. | |
| 5,092,500 A | 3/1992 | Weber et al. | |
| 5,198,126 A | 3/1993 | Lee | |
| 6,027,051 A | 2/2000 | Heaslip et al. | |
| 6,425,505 B1 * | 7/2002 | Heaslip et al. | 222/594 |
| 6,435,385 B1 * | 8/2002 | Marukawa et al. | 222/594 |

OTHER PUBLICATIONS

Iron and Steel Society I&SM Magazine, Apr. 2002, p. 4, International Report Japan, Sumitomo, Kyushu Development SEN.

* cited by examiner

*Primary Examiner*—Scott Kastler
(74) *Attorney, Agent, or Firm*—Harold I. Masteller, Jr.

(57) ABSTRACT

The present invention provides an improved submerged entry nozzle (SEN) for use in a continuous casting machine. The SEN includes a connection end adapted to attach to a slide gate mechanism, a discharge end including a bifurcated port, a tapered bore extending between the connection end and the discharge end, and a flow control structure positioned within the discharge end. The flow control structure includes divergent flow control surfaces extending downward along opposite sides of a contiguous edge, each downwardly extending divergent flow control surface flaring in an outward direction toward a respective perimeter defining an outside edge of the bifurcated port and communicating therewith.

40 Claims, 7 Drawing Sheets

Fig. 2
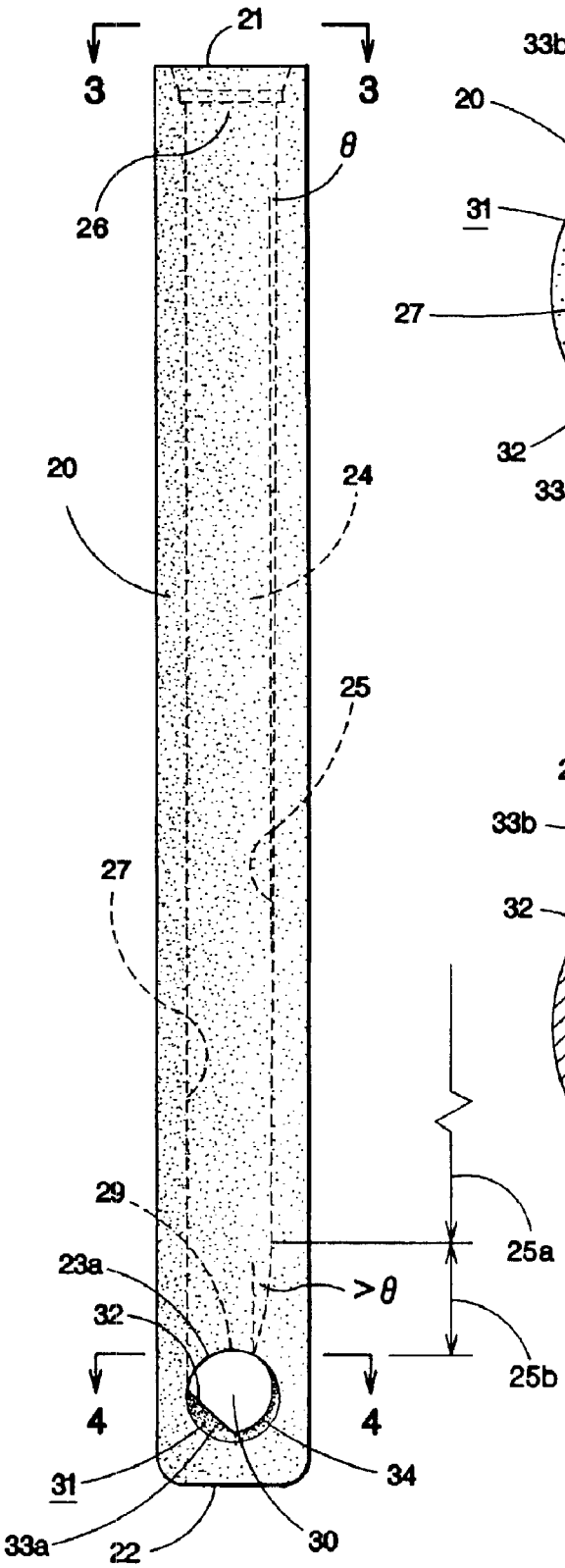
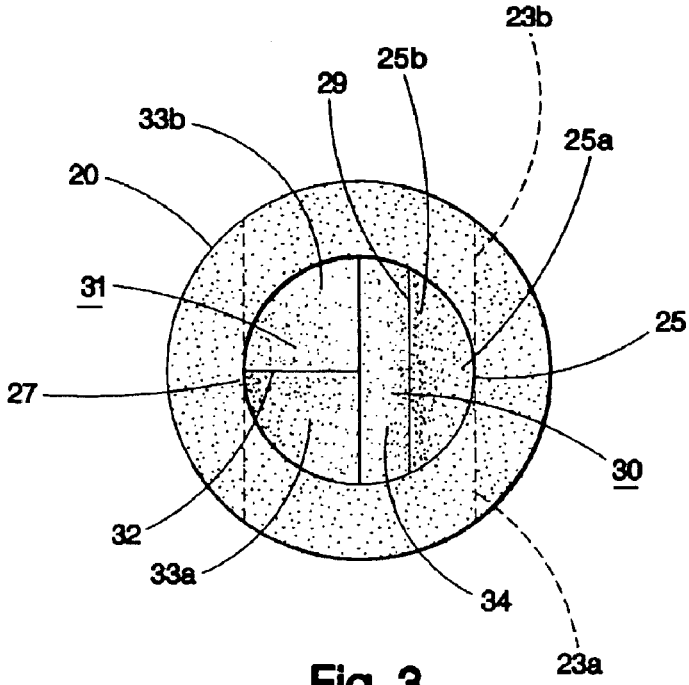
Fig. 3
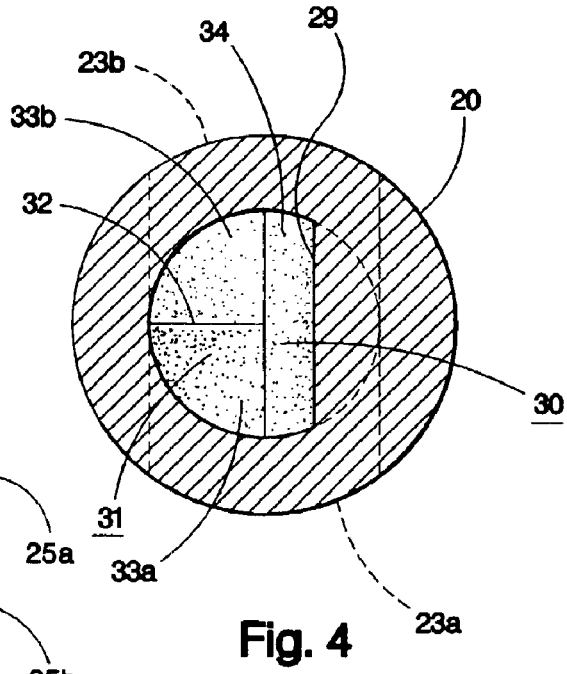
Fig. 4

Fig. 8
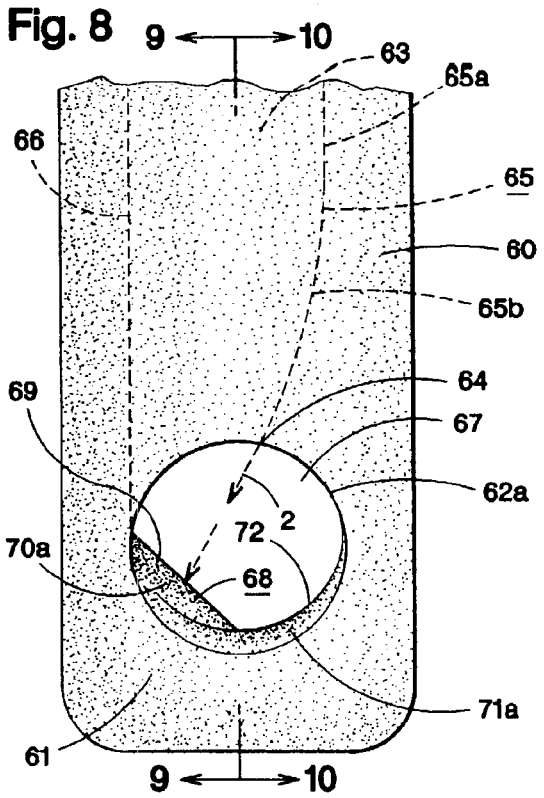
Fig. 11
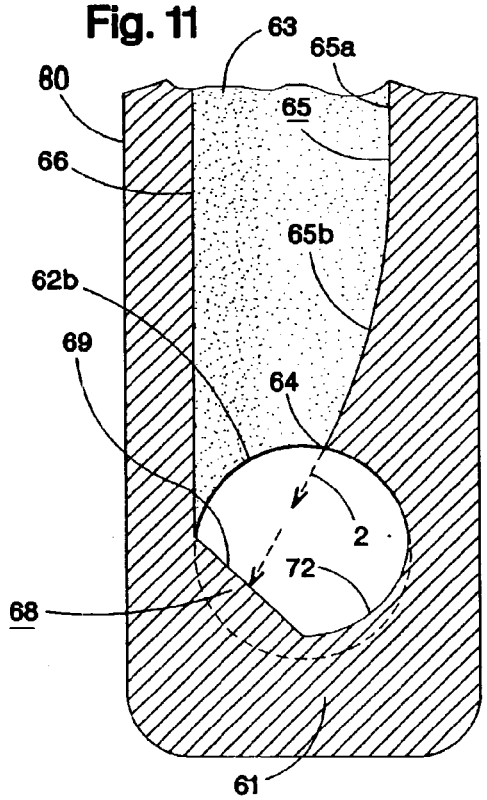
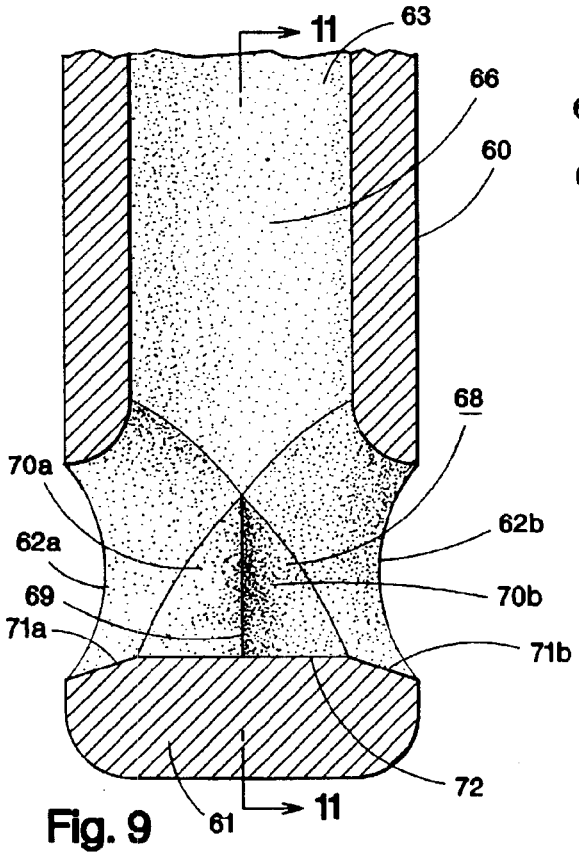
Fig. 9
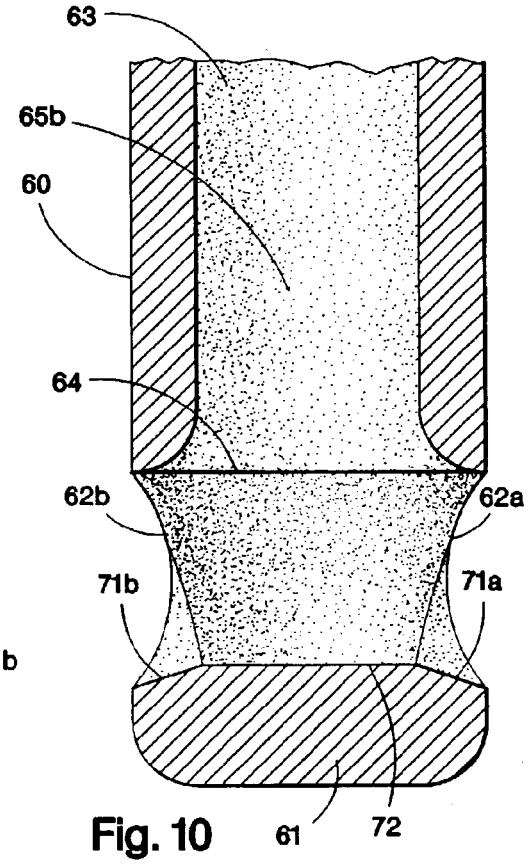
Fig. 10

24
20
86
F1
83
F2
82a
82b
F3
F4
F5
84
38
23b, 62b
23a, 62a
5
W
65
25a, 65a
80
81
25b, 65b
80'
36
80''
34, 72
23a
22
24, 63
27, 66
29
35
32, 69
31, 68
30, 67

SUBMERGED ENTRY NOZZLE AND METHOD FOR MAINTAINING A QUIET CASTING MOLD

FIELD OF THE INVENTION

The present invention is directed to a submerged entry nozzle (SEN) that delivers a stream of molten steel from a tundish to a continuous casting mold, and in particular, to a SEN that improves the molten steel flow patterns and reduces turbulence within the continuous caster mold.

BACKGROUND OF THE INVENTION

There has been a continuing effort to improve steel flow circulation and reduce turbulence in a continuous casting mold receiving a stream of molten steel delivered through a SEN. One particular improvement is the development of a bifurcated port discharge end that enables better distribution of the molten steel delivered to the casting mold, for example as disclosed in Cahoon (U.S. Pat. No. 4,487,251) or Lee (U.S. Pat. No. 5,198,126).

However, although such bifurcated port nozzles improve molten steel flow patterns within casting molds, the past SEN designs fail to maintain a calm or still liquid reservoir of molten steel within the mold. For example, when it is necessary for operators to adjust the slide gate that controls the rate of molten steel draining from the tundish to the mold, such slide gate adjustments cause disruptive or erratic changes in the molten steel flow discharged from the bifurcated port into the caster mold. Such erratic changes make it difficult to maintain good flow control within the mold. Additionally, the steel flow fluctuations associated with slide gate adjustments may form eddies and/or vortexes within the molten steel reservoir and entrain mold powder and/or slag within the cast steel product.

SUMMARY OF THE INVENTION

It is therefore an object of the present invention to provide an improved SEN that reduces steel flow fluctuations associated with slide gate adjustments.

It is another object of the present invention to provide a SEN that improves distribution flow patterns of molten steel delivered to a continuous casting mold under all cast steel flow rates.

It is still another object of the present invention to provide a SEN that reduces surface turbulence in the molten steel reservoir contained in a continuous casting mold.

In satisfaction of the foregoing objects and advantages, the present invention provides an improved submerged entry nozzle for use in a continuous casting machine. The improved SEN includes a connection end adapted to attach to a slide gate mechanism, a discharge end including a bifurcated port, a tapered bore extending between the connection end and the discharge end, and a flow control structure positioned proximate the bifurcated port. The flow control structure includes divergent flow control surfaces extending downward along opposite sides of a contiguous edge, each downwardly extending divergent flow control surface flaring in an outward direction toward a respective perimeter defining an outside edge of the bifurcated port and communicating therewith.

BRIEF DESCRIPTION OF THE DRAWINGS

The above and other objects, advantages, and novel features of the present invention will become apparent from the following detailed description of the preferred embodiment of the invention illustrated in the accompanying drawings, wherein:

FIG. 2 is an elevation view of the submerged entry nozzle (SEN) of one embodiment of the present invention.

FIG. 3 is a top view taken along the lines 3—3 of FIG. 2.

FIG. 4 is a cross-section view taken along the lines 4—4 of FIG. 2.

FIG. 8 is an enlarged view showing another embodiment of a bifurcated port end portion in the SEN of the present invention.

FIG. 9 is a cross-section view taken along the lines 6—6 of FIG. 8.

FIG. 10 is a cross-section view taken along the lines 7—7 of FIG. 8.

FIG. 11 is a cross-section view taken along the lines 7—7 of FIG. 9.

DETAILED DESCRIPTION OF THE PREFERRED EMBODIMENT

Figure 1:
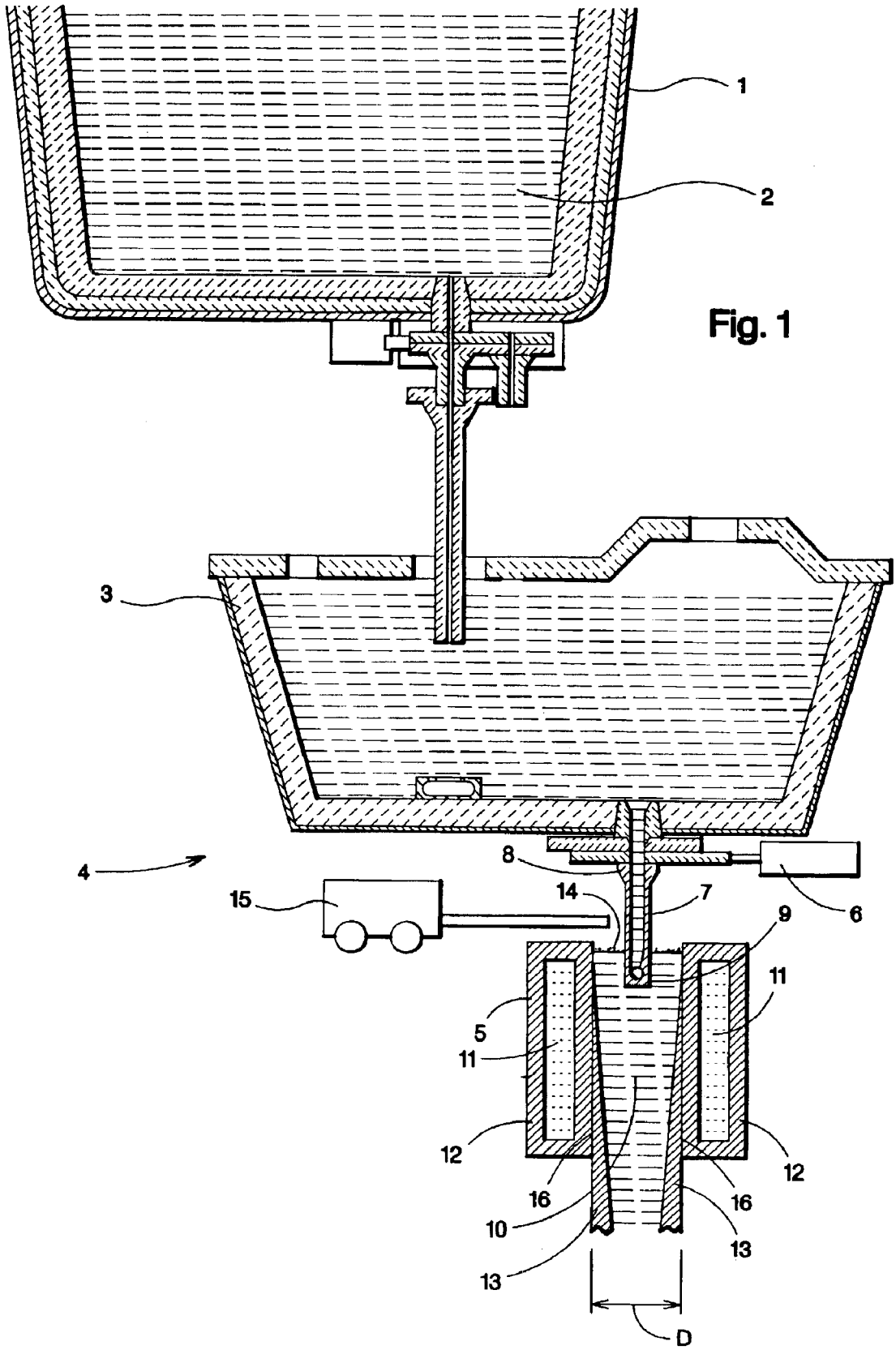
FIG. 1 is a view of a continuous casting machine.
Figure 5:
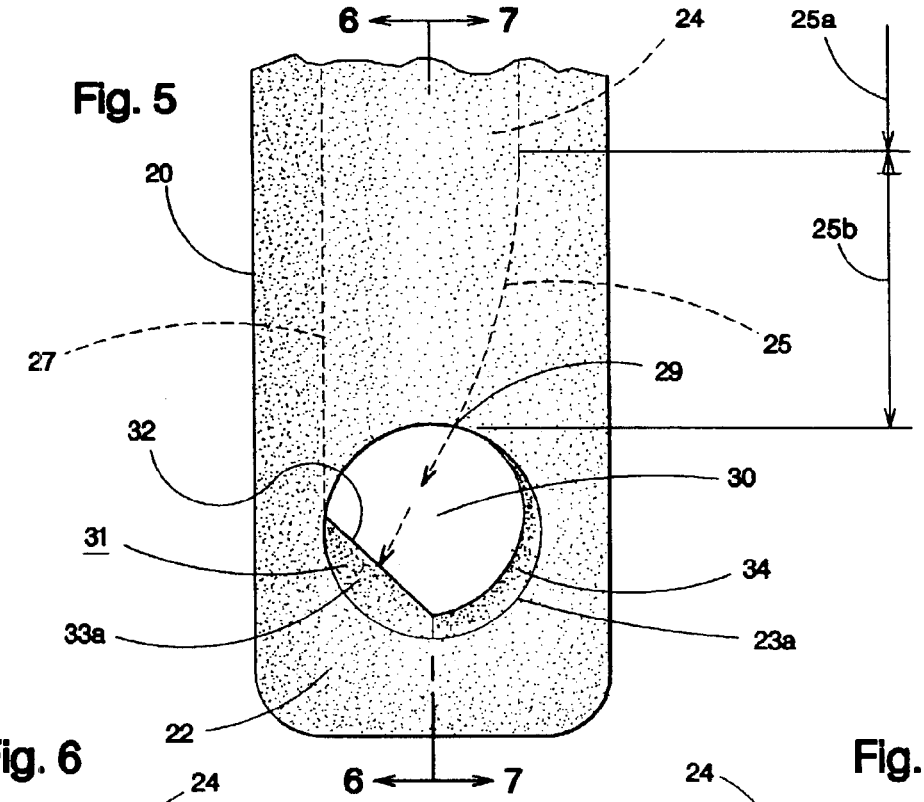
FIG. 5 is an enlarged view of the bifurcated port end portion of FIG. 2.

The following detailed description is directed to preferred embodiments of the present invention for delivering a stream of molten steel from a tundish to a continuous casting mold. The invention comprises a submerged entry nozzle (SEN) having an improved bore and discharge end capable of delivering molten steel flow patterns that reduce surface turbulence within the reservoir of molten steel contained in the mold. Referring to FIG. 1, in a continuous casting operation, a ladle 1 delivers molten steel 2 from a steelmaking furnace (not shown) to the tundish 3 in a continuous casting machine 4. Tundish 3 provides an uninterrupted reservoir of molten steel supplied to a caster mold 5, the caster mold having a depth D and a width W represented by the direction arrow shown in FIG. 16. The continuous stream of molten steel delivered from tundish 3 to the caster mold 5 is controlled by a slide gate valve mechanism 6, and in the present invention, the molten steel is delivered to caster mold 5 through a submerged entry nozzle 7 comprising a refractory tube shroud attached to slide gate 6. The SEN 7 includes a connection end 8 adapted to couple to the slide gate mechanism 6, and a discharge end 9, that is immersed below the surface of the molten steel 10 contained in caster mold 5. Solidification of the cast molten steel begins within the caster mold. To promote solidification, cooling waters 11 are circulated through a copper alloy jacket 12 so that the molten steel is chilled and a solidified skin 13 is formed along the periphery of the cast steel product before it moves downstream through various roll racks and cooling sprays (not shown) that complete the continuous casting operation.

Casting machines may also include means to distribute mold powder compounds 14 onto the surface of the cast molten steel reservoir 10. Mold powders may be added either manually with rakes or by mechanical feeders 15 as shown in FIG. 1. On contact with the molten steel, the mold powder 14 melts forming a liquid slag that provides a lubricant between the mold walls 16 and the solidifying steel skin 13. In past SEN designs, whenever it became necessary to adjust the slide gate mechanism 6, the gate adjustment created fluctuations in the steel flow draining from the tundish. This caused erratic discharges of molten steel from the SEN into the caster mold 5. Such erratic discharge may create eddies and/or vortexes that tend to entrain mold powders 14 and/or slag within the cast steel product. Additionally, in such past SEN devices, slide gate adjustment and/or changes in cast flow rates, produce a preferential flow from one of the port openings that results in a higher discharge of steel from the SEN to one side of the caster mold 5. Such conditions create an increased possibility for shearing mold powder 14 from the coverage layer and entraining it into the cast steel product. The improved SEN device of the present invention is capable of dividing the incoming flow of liquid steel 2 from tundish 1 into substantially equal portions so that a similar volume and velocity of liquid steel 10 is discharged from each port opening into opposite sides of the caster mold 5 under all cast steel flow rates.

Referring to FIGS. 2–7, the improved SEN of the present invention provides a controlled molten steel flow stream that eliminates, or greatly reduces, erratic molten steel discharges associated with slide gate adjustments. The controlled flow stream eliminates eddies and/or vortexes associated with slide gate adjustments and thereby eliminates, or significantly reduces, entrainment of mold powders and slags within the cast steel product. The one embodiment of the present SEN invention comprises an elongated refractory tube 20 having a connection end 21 suited for attachment to a tundish slide gate mechanism, and a discharge end 22 having a bifurcated port defined by opposed discharge openings 23*a* and 23*b* that deliver a flow of molten steel 2 from the SEN into a caster mold. A bore 24 extends between a feed side opening 26 in connection end 21 and a terminus opening 29 communicating with discharge end 22. Bore 24 includes a tapered bore wall portion 25 extending along a length of the bore in a downward direction from a location proximate feed side opening 26 to the terminus opening 29, and the tapered bore wall portion 25 is angled toward a vertical bore wall portion 27 provided in bore 24. The tapered portion 25 may be further defined by a first tapered bore wall segment 25*a* proximate feed side opening 26 and angled toward the vertical bore wall portion at an angle θ, and a second tapered bore wall segment 25*b* extending between segment 25*a* and terminus opening 29. The second tapered bore wall segment 25*b* is angled toward the vertical bore wall portion 27 at an angle greater than θ (FIG. 2).

Discharge end 22 includes a chamber 30 shaped to generate a spiral flow of molten steel within chamber 30, and a flow control structure or diverter 31 positioned to receive an incoming stream of molten steel 2 from the SEN bore 24. Diverter 31 includes a knife-edge 32 angled in a downward direction from the vertical bore wall portion 27 to a location below terminus opening 29 so that it is positioned to receive incoming molten steel 2 from the second tapered bore wall segment 25*b*. The flow control structure or diverter 31 also includes divergent, concave shaped, flow control surfaces 33*a* and 33*b* that extend downward along opposite sides of the contiguous knife-edge 32. Surfaces 33*a* and 33*b* flare downward and outward from knife-edge 32 so that each surface 33*a* and 33*b* communicates with a perimeter that defines the opposed outside edges 23*a* and 23*b* of their respective bifurcated port. Discharge chamber 30 also includes a curved pad 34 positioned between and facially engaging the fan shaped surfaces 33*a* and 33*b*. Curved pad 34 comprises a substantially helical shape that spirals away from diverter 31 in an upward direction so that it tangentially engages terminus opening 29 proximate the intersection between opening 29 and the second tapered bore wall segment 25*b*.

Referring to FIGS. 8–11, another embodiment of the present SEN invention comprises an elongated refractory tube 60 having a connection end (not shown) suited for attachment to a tundish slide gate mechanism, and a discharge end 61 having a bifurcated port defined by opposed discharge openings 62*a* and 62*b* that deliver a flow of molten steel from the SEN into a caster mold. A bore 63 extends between a feed side opening in connection end (not shown) and a terminus opening 64 communicating with discharge end 61. Bore 63 includes a tapered bore wall portion 65 similar to FIG. 2, and the tapered bore wall portion is angled toward a vertical bore wall portion 66 provided in bore 63. Similar to the embodiment disclosed in FIG. 2, tapered portion 65 may include a first tapered bore wall segment 65*a* angled toward the vertical bore wall portion at an angle θ, and a second tapered bore wall segment 65*b* angled toward the vertical bore wall portion 27 at an angle greater than θ.

Discharge end 61 includes a discharge chamber 67 shaped to generate a spiral flow of molten steel within chamber 67, and a flow control structure or diverter 68 positioned to receive an incoming stream of molten steel from the SEN bore 63. Chamber 67 Diverter 68 includes a knife-edge 69 angled in a downward direction from the vertical bore wall portion 66 to a location below terminus opening 64 so that it is positioned to receive incoming molten steel from the second tapered bore wall segment 65*b*. The flow control structure or diverter 68 includes convex shaped flow control surfaces 70*a* and 70*b* that extend downward along opposite sides of the contiguous knife-edge 69. Surfaces 70*a* and 70*b* flare downward and outward from knife-edge 69 so that each surface 70*a* and 70*b* communicates with a respective chamfered edge 71*a* and 71*b* extending along at least a portion of the outside edges 62*a* and 62*b* defining the bifurcated port openings. Discharge chamber 67 also includes a curved pad 72 positioned between and facially engaging the fan shaped surfaces 70*a* and 70*b*. Curved pad 72 comprises a substantially helical shape that spirals away from diverter 68 in an upward direction so that it tangentially engages each chamfered edge 71*a* and 71*b*.

Figures 12A, 12B, 12C:
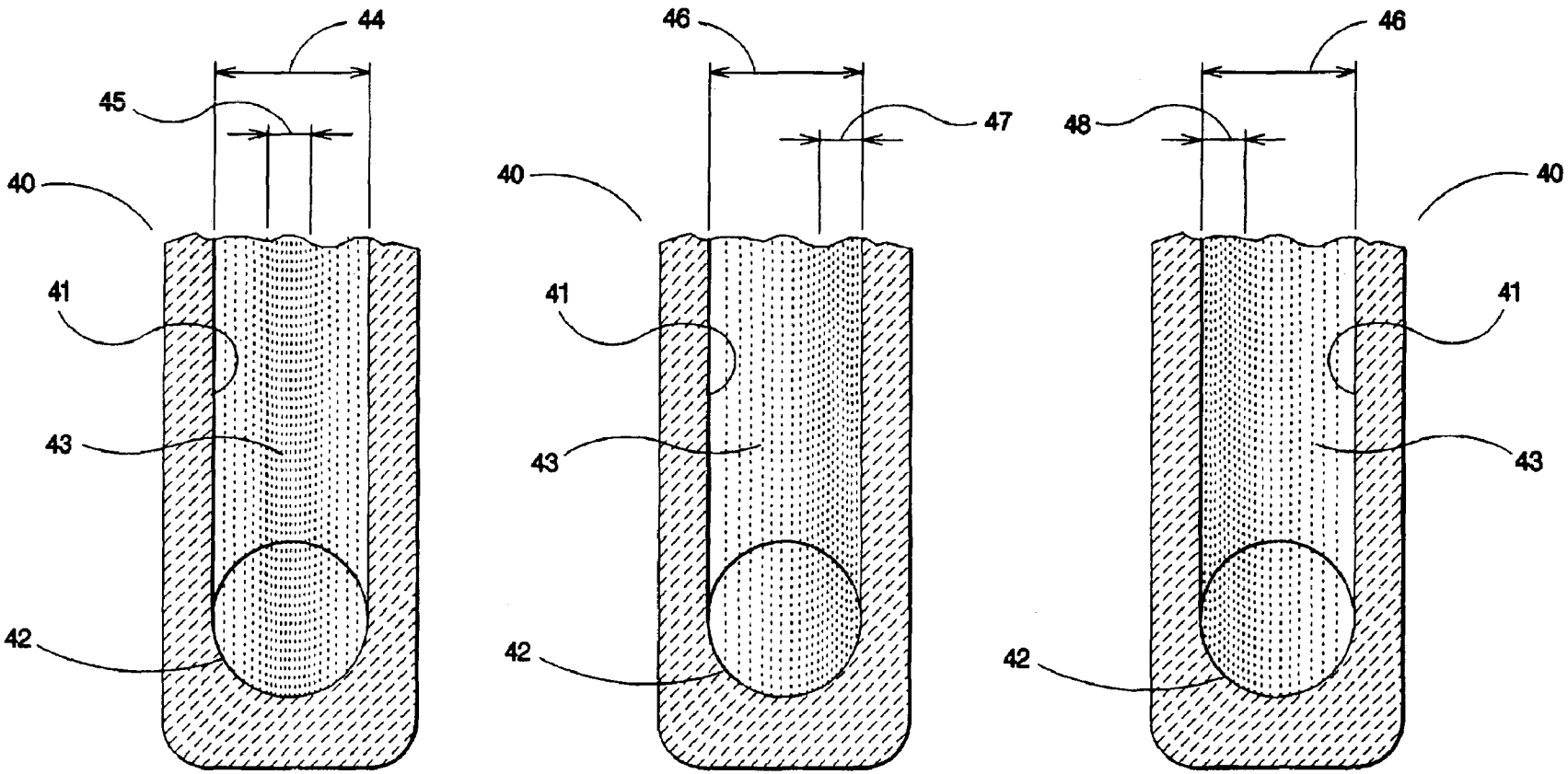
Fig. 12A Prior Art
Fig. 12B Prior Art
Fig. 12C Prior Art
FIG. 12A labeled prior art, is a cross-section showing a symmetrical molten steel flow through the bore of a SEN.
FIG. 12B labeled prior art, is a cross-section showing an asymmetrical molten steel flow through the bore of a SEN.
FIG. 12C labeled prior art, is a cross-section showing a different asymmetrical molten steel flow through the bore of a SEN.

Referring to FIGS. 12A–12C, labeled Prior Art, a submerged entry nozzle 40 having a bore 41 and bifurcated discharge port 42, is shown draining steel 43 from a continuous caster tundish (not shown). The draining molten steel 43 is illustrated as a series of parallel dotted lines. In such past SEN devices, the draining molten steel 43 exhibits a continuously changing velocity gradient across the width or diameter of the SEN bore 41, the changing velocity gradient being effected by the position of slide gate and/or the adjusted size of the nozzle opening and/or cast steel flow rates. For example, FIG. 12A shows a substantially symmetrical velocity gradient 44 having a higher velocity concentration 45 along the central axis of the SEN bore. Such symmetrical velocity gradients typically occur when the slide gate is adjusted for a large nozzle opening that provides a higher cast steel flow rate draining from the tundish. On the other hand, when casting conditions require a reduced flow volume or flow rate, the sliding gate must be adjusted to stop down the nozzle opening size. This results in creating an asymmetrical velocity gradient 46 across bore 41 as illustrated in FIGS. 12B and 12C. Depending upon certain casting conditions, the particular slide gate mechanism, and upon the amount and shape of wear within bore 41, a higher velocity concentration 47 may occur along one side of the bore wall as shown in FIG. 12B, or along a different side of the bore wall shown as 48 in FIG. 12C. In either case, the high velocity gradient across the molten steel flow is a random occurrence and is substantially uncontrolled by steelmakers.

Figure 13A:
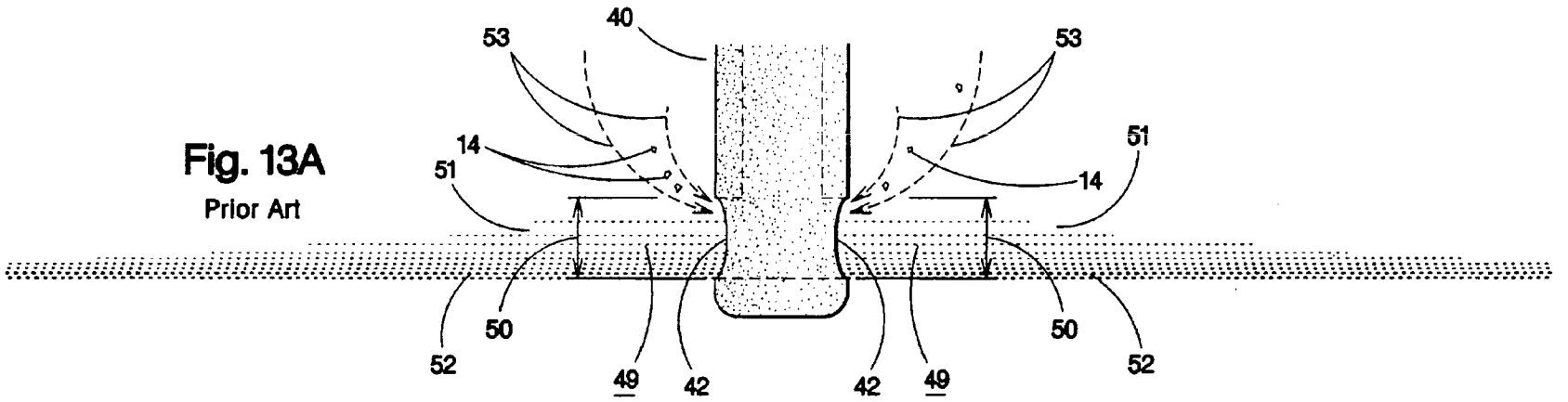
Fig. 13A Prior Art
FIG. 13A labeled prior art, is an elevation view showing the discharge of molten steel from the bifurcated port in FIG. 12A.

Consequently, referring to FIG. 13A labeled Prior Art, in the instance where the draining liquid steel has a symmetrical high velocity gradient (FIG. 12A); substantially equal amounts of steel are discharged at similar velocities from each port opening 42 into opposite sides of the caster mold. However, under such cast steel conditions, using SEN devices of the past, the discharged flow of molten steel 49 has a high velocity gradient 50 from the bottom to the top of the bifurcated port. In such instances, the low velocity portion of the gradient 51 is along the top of the port openings 42. This creates a reduced pressure at the top of opening 42 and causes an inward flow or backflow of molten metal 53 back into the SEN port. Such backflow creates eddies or vortexes that shear or draw mold powders and/or slag from the cover layer floating on the surface of the cast steel and back into the SEN. The foreign particles are discharged from the SEN and mixed into the molten steel contained within the caster mold where they form inclusions in the cast steel product.

Figure 13B:
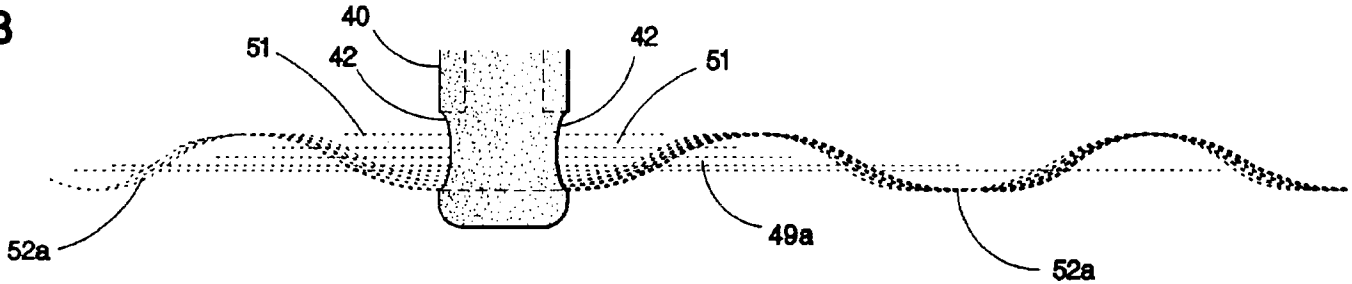
Fig. 13B Prior Art
FIG. 13B labeled prior art, is an elevation view showing the discharge of molten steel from the bifurcated port in FIG. 12B.
Figure 13C:
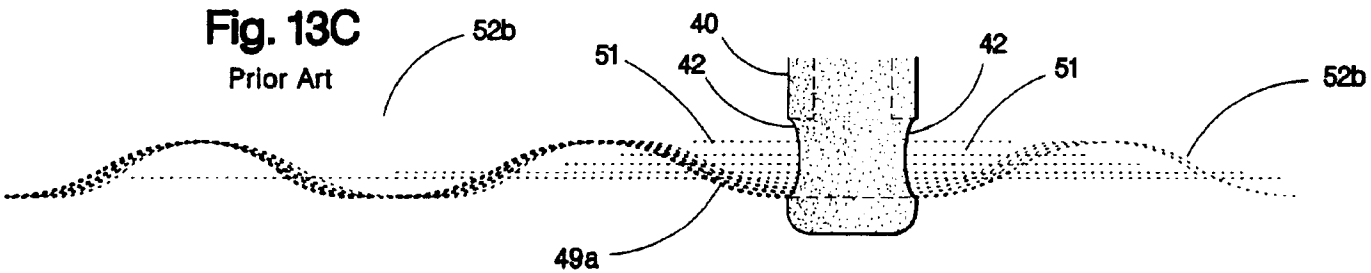
Fig. 13C Prior Art
FIG. 13C labeled prior art, is an elevation view showing the discharge of molten steel from the bifurcated port in FIG. 12C.

Referring to FIGS. 13B and 13C, also labeled Prior Art, under certain casting conditions, for example when the slide gate setting causes an asymmetrical flow having a higher velocity concentration 47 along one side of the SEN bore as shown in FIG. 12B, the asymmetrical high velocity gradient causes a preferential flow 49*a* discharged from one of the port openings 42 rotating in either a clockwise 52*a* or counter clockwise 52*b* direction. When it becomes necessary to adjust the slide gate mechanism control the cast steel flow rate, there is a possibility that the changed gate setting will cause the asymmetrical flow pattern to suddenly flip/flop between the higher velocity concentration 47 shown in FIG. 12B and the different higher velocity concentration 48 shown in FIG. 12C. This sudden change in the flow pattern will cause an equally sudden change in rotation and preferential flow direction 49*a* of the molten steel discharge from opening 42 as shown in FIG. 13C. Such sudden direction and rotation changes in the molten steel discharge create turbulence within the caster mold and further increase the likelihood of mold powder shear and entrainment within the cast steel product. Additionally, the preferential flow discharge 49*a* results in one side of the caster mold being too active. This creates a turbulent cast steel surface where a quiet surface is desired to prevent mold powder and/or slag entrainment. Furthermore, the sudden flip/flop in the rotation and preferential flow direction causes a quiet/upset/quiet condition within the mold. It is always viewed as problematic by steelmakers when the steady state condition in a caster mold becomes unsettled.

Figure 6:
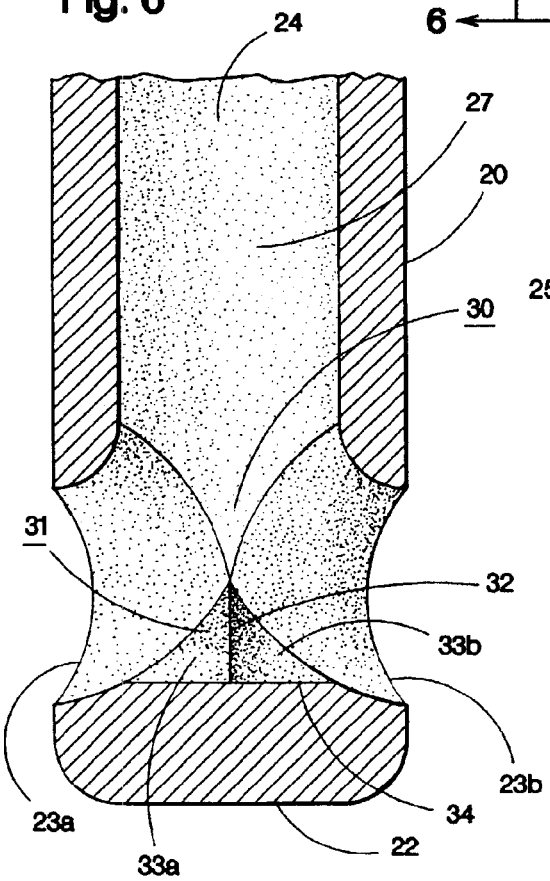
FIG. 6 is a cross-section view taken along the lines 6—6 of FIG. 5.
Figure 7:
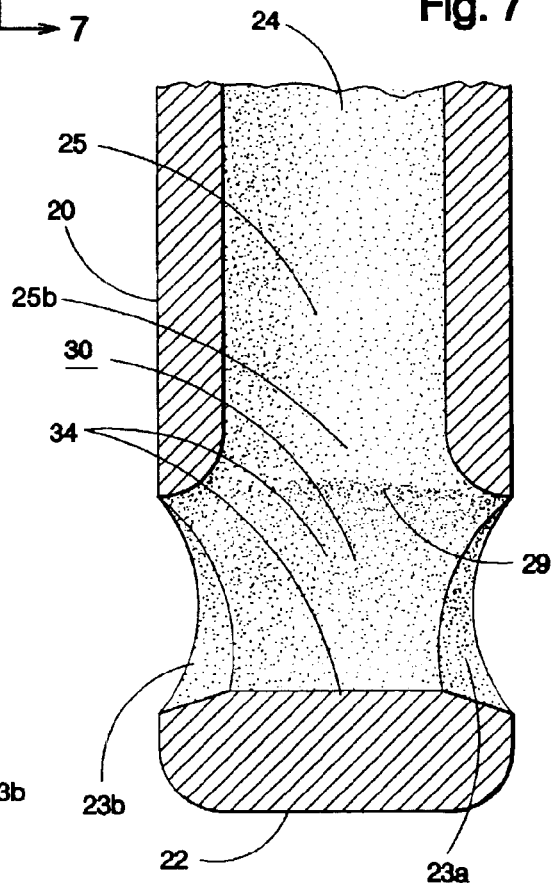
FIG. 7 is a cross-section view taken along the lines 7—7 of FIG. 5.
Figures 14, 15:
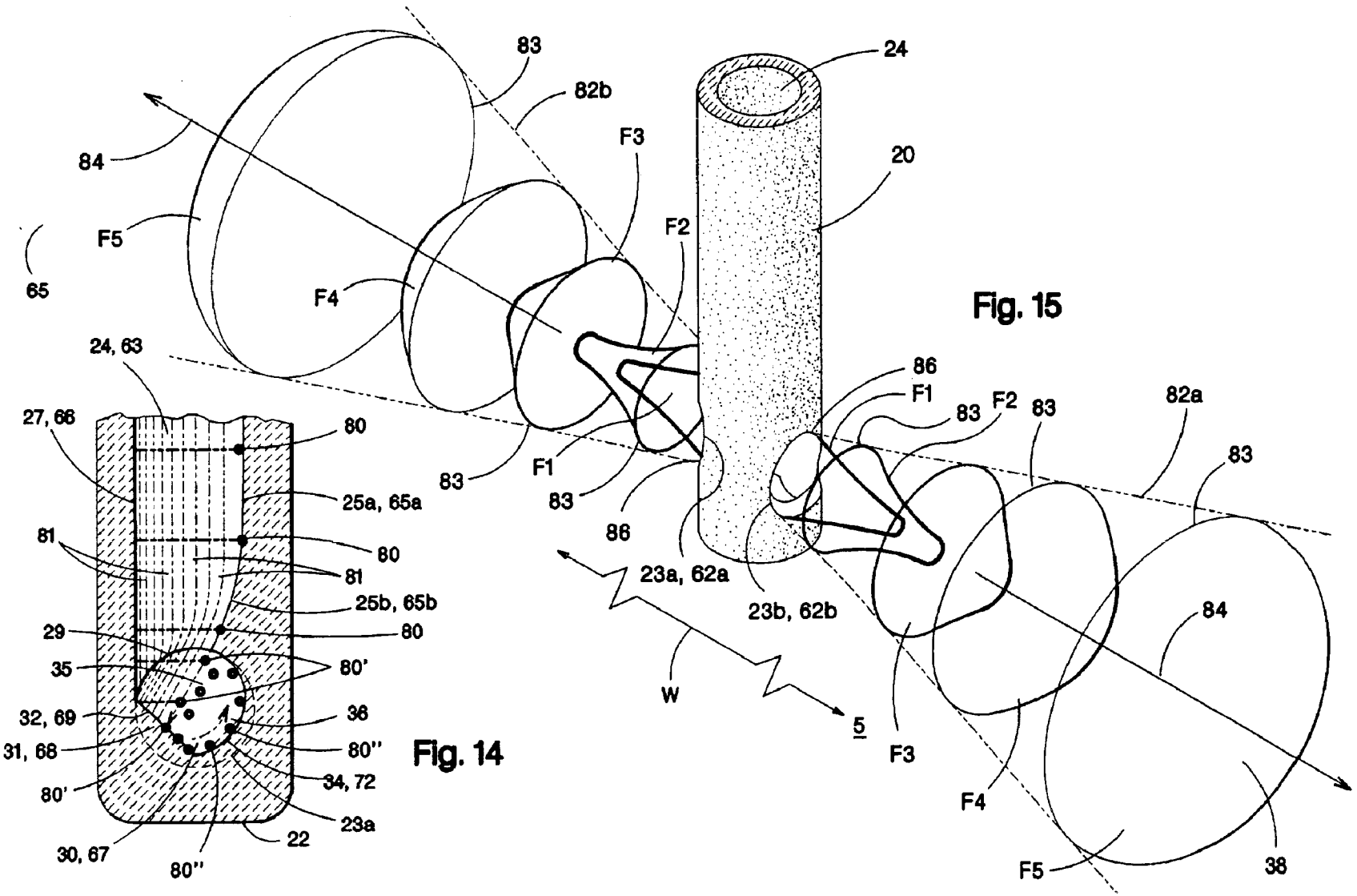
FIG. 14 is an isometric view that schematically illustrates the flow pattern in molten steel discharged from the present SEN invention.
FIG. 15 is a schematic view showing incoming steel moving through a caster mold.

Referring to FIG. 6, FIG. 9, and FIG. 14, reference numbers 80 show different positions "snapshots" of the same section of the molten steel flow as it drains through the SEN bore 24, or 63. The first tapered section 25*a*, 65*a* extends downward from a location proximate the bore feed side opening (FIG. 2) and gradually directs the downward draining steel, shown as a series of parallel phantom lines 81, toward the opposite bore wall portion 27, 66. The second tapered section 25*b*, 65*b* further narrows or restricts bore 24, 63 from the first tapered section through terminus opening 29, 64 that communicates with discharge chamber 30. The length of the tapered bore wall portion 25, 65 (FIG. 2) is shaped to create a gradual narrowing passageway that directs a concentrated flow of draining molten steel along a selected length of the bore wall, for example, in this instance the opposite bore wall 27, 66. This produces an increasing high velocity gradient across the draining molten steel as illustrated by a series of snapshots 80 of the molten steel as it drains downward through bore 24, 63. The tapered portion 25, 65 directs the draining steel in a predetermined downward flow path along the bore, and the steel flow exits terminus end 29, 69 as a concentrated steel stream 80' having an angle tangential to the slope of the second tapered bore wall segment 25*b*, 65*b*. As shown in FIG. 14, the directed, angled steel stream 80' always impacts upon diverter 31, 68 at the same location along knife-edge 32, 69, and the impacting steel stream 81' is always divided into substantially equal discharge flows 80" within discharge chamber 30, 67. Such predetermined flow control prevents the troublesome flip/flop changes and eliminates or reduces surface turbulence as discussed above.

Each divided molten steel flow 80" follows the contour of its respective divergent flow control surface 33*a*, 70*a* and 33*b*, 70*b*, and at least a portion of the divided steel flow is directed along the shaped pad portions 34, 72 shown in FIGS. 6 and 9, the shaped pad portions providing a helical path that causes the divided steel flow to spiral within chamber 30, 67. The divided steel flows 80" spiral in a direction perpendicular to the bifurcated port and along the periphery of each bifurcated port opening 23*a*, 62*a* and 23*b*, 62*b* where molten steel flows 82*a* and 82*b* are discharged from the SEN in opposite directions along the width W of caster mold 5 (FIG. 15). Referring to FIGS. 14 and 15, the swirling steel 80" causes each discharge of incoming new steel 82*a*, 82*b* to have a high velocity gradient extending from the steel discharge periphery or circumference 83 toward its central axis or core 84, and the swirling steel at the periphery of the port openings 23*a*, 62*a* and 23*b*, 62*b* creates an equalized pressure zone 86 that eliminates the reduced pressure and back flow problems discussed above and shown in FIG. 13A.

Referring in particular to FIG. 15, the drawing shows a series of snapshots F1–F5 that schematically represent the same section of incoming new steel as it moves along the width of a caster mold. Water modeling tests reveal that, although the divided molten steel swirls within the SEN discharge chamber, there is only a slight rotation or no rotation in the incoming steel 82*a*, 82*b* after it enters the caster mold. Additionally, the high velocity gradient causes the incoming new steel to blossom or open into the substantially umbrella or mushroom like shapes shown at F1–F5. As the blossoming steel 82*a*, and 82*b* move in opposite directions along mold width W, the surface area of blossoming shape is increased so that the improved steel flow 82*a*, and 82*b* has a reduced volume to surface ratio as compared to the steel flow 49 generated by the SEN devices of the past (FIGS. 13A–13C). Accordingly, the larger surface area 82*a* and 82*b* dissipates energy faster than SEN devices of the past, and the improved energy dissipation provides a more quiet condition within the caster mold.

It should be understood that while this invention has been described as having a preferred embodiment, it is capable of further modifications, uses, and/or adaptations of the invention, following the general principle of the invention and including such departures from the present disclosure as have come within known or customary practice in the art to which the invention pertains, and as may be applied to the central features hereinbefore set forth, and fall within the scope of the invention of the limits of the appended claims. For example, while the detailed description is directed to a continuous casting operation, the improved flow control features of the present SEN device may be adapted for use outside the steelmaking art without departing from the scope of this invention. For example, the improved flow control features of the present invention may be adapted for use in liquid delivery systems used in non-ferrous metal industries, food and beverage industries, and municipal water service applications.

I claim:

1. A submerged entry nozzle, comprising:

a) a connection end adapted to attach to a slide gate mechanism;

b) a bore extending from said connection end to a terminus end, said bore including a tapered wall segment and a vertical wall segment along the length thereof, said tapered wall segment shaped to create a gradual narrowing passageway that directs a concentrated flow of draining molten steel along said vertical wall segment to create an increasing high velocity gradient across the molten steel draining downward through said bore to said terminus end; and c) a bifurcated port discharge chamber, said discharge chamber including a diverter having a knife-edge positioned within said discharge chamber so that said draining concentrated steel flow always impacts at the same location along said knife-edge, and so that said concentrated steel flow is always divided by said knife-edge into substantially equal molten steel flows within said discharge chamber, said diverter shaped to cause each said divided molten steel flew to spiral in a direction perpendicular to said bifurcated port along a periphery of each bifurcated port opening, said perpendicular spiral flow discharged from said submerged entry nozzle into a continuous caster mold.

2. The invention recited in claim 1 wherein said tapered wall segment extends downward from a position proximate said connection end to said terminus end, said tapered bore wall segment angled in a direction toward a vertical wall segment extending along said bore.

3. The invention recited in claim 2 wherein said tapered wall segment includes:

a) a first tapered section extending downward from a position proximate said connection end, said first tapered section angled toward said vertical wall segment at an angle θ; and b) a second tapered section extending between said first tapered section and said terminus end, said second tapered section angled toward said vertical wall segment at an angle greater than θ.

4. The invention recited in claim 3 wherein said second tapered section is arcuate.

5. The invention recited in claim 2 wherein said vertical wall segment is opposite said tapered wall segment.

6. The invention recited in claim 2 wherein said vertical wall segment is adjacent said tapered wall segment.

7. The invention recited in claim 1 wherein said diverter comprises:

a) at least two flow control surfaces extending downward along opposite sides of said knife-edge, each said flow control surface flared toward and defining said periphery of each bifurcated port opening.

8. The invention recited in claim 7 wherein said discharge chamber includes a curved pad member located opposite said control structure, said curved pad member having a curvilinear surface extending toward said terminus end of said bore.

9. The invention recited in claim 7 wherein said at least two flow control surfaces are concave surfaces.

10. The invention recited in claim 7 wherein said at least two flow control surfaces are convex surfaces.

11. The invention recited in claim 7 wherein at least a portion of said periphery that defines said bifurcated port opening is chamfered.

12. The invention recited in claim 8 wherein said knife-edge extending along said diverter is angled in a downward direction from said vertical bore wall portion toward said curved pad.

13. A submerged entry nozzle, comprising:

a) a connection end adapted to attach to a slide gate mechanism;

b) a discharge end having a bifurcated port;

c) a bore extending between said connection end and said discharge end; and d) a diverter positioned within said discharge end, said diverter including;

i) divergent flow control surfaces extending downward along opposite sides of a contiguous edge, each said flow control surface flaring in an outward direction toward a respective perimeter that defines an outside edge of a bifurcated port opening so that each said flow control surface communicates with a bifurcated port opening, said divergent flow control surfaces positioned to receive an incoming molten metal flow drained through said bore and ii) a curved pad member interfacially aligned with each said flow control surface and having one end contiguous with said bore, said contiguous edge dividing said incoming molten metal flow into two substantially equal molten steel flows within said discharge chamber, the combination said flow control surfaces and said curved pad member shaped to cause each said divided molten steel flow into a spiral flow perpendicular to and along said perimeter of each bifurcated port opening, each said perpendicular spiral flow discharged into a continuous caster mold.

14. The invention recited in claim 13 wherein said contiguous edge is angled in a downward direction toward said curved pad member.

15. In a continuous casting machine comprising a tundish and mold positioned above roll racks and cooling sprays, an improved submerged entry nozzle for delivering a flow of molten steel draining from the tundish to the mold, the improved submerged entry nozzle comprising:

a) a connection end adapted to attach to a slide gate mechanism fastened to the tundish;

b) a discharge end having a bifurcated port extending there through, said discharge end immersed within molten steel contained in the mold; and c) a bore extending between said connection end and the discharge end, said bore including a bore wall having a tapered wall segment extending along a length of said bore wall, said tapered wall segment angled in a downward direction toward a vertical wall segment extending along said bore wall, and d) a deflector positioned within said discharge end, said deflector including divergent flow control surfaces extending downward along opposite sides of a contiguous edge, each said flow control surface shaped to flare in an outward direction toward a respective outside edge that defines a discharge opening in said bifurcated port, said contiguous edge positioned within said discharge end to receive the molten steel flow draining from the tundish so that said molten steel flow always impacts at the same location along said continuous edge, and so that the molten steel flow is always divided by said contiguous edge into substantially equal molten steel flows within said discharge end, whereby each said shaped flow control surface directs each divided molten steel flow into a spiral perpendicular to and along said outside edge that defines said bifurcated port opening, said perpendicular spiral flow discharged from said submerged entry nozzle into the molten steel contained in the mold.

16. The invention recited in claim 15 wherein, said tapered wall segment includes;

a) a first tapered section extending downward from said connection end, said first tapered section angled toward said vertical wall segment at an angle θ; and b) a second tapered section extending between said first tapered section and said discharge end, said second tapered section angled toward said vertical wall segment at an angle greater than θ.

17. The invention recited in claim 16 wherein said second tapered section is curved.

18. The invention recited in claim 15 wherein said vertical wall segment is opposite said tapered wall section.

19. The invention recited in claim 15 wherein said vertical wall segment is adjacent said tapered wall section.

20. The invention recited in claim 15 wherein said discharge end includes a pad member located opposite said deflector, said pad member having a curvilinear surface.

21. The invention recited in claim 15 wherein the divergent flow control surfaces are concave surfaces.

22. The invention recited in claim 15 wherein the divergent flow control surfaces are convex surfaces.

23. The invention recited in claim 15 wherein at least a portion of said outside edge that defines an opening of the bifurcated port is chamfered.

24. The invention recited in claim 15 wherein said contiguous edge of said divergent flow control surfaces is angled in a downward direction from said vertical bore wall portion toward said pad.

25. A method for maintaining a quiet cast in a continuous caster mold, the steps of the method comprising:

a) providing a submerged entry nozzle having a bore that includes a tapered wall segment that directs molten steel into a an increasing high velocity gradient flow of molten steel concentrated along a vertical wall segment as the molten steel drains downward through the bore;

b) providing a diverter within a discharge end having a bifurcated port, said diverter comprising flow control surfaces extending downward along opposite sides of a contiguous edge, each said flow control surface shaped to flare in an outward direction toward a periphery defining a discharge opening in said bifurcated port;

c) causing said concentrated molten steel flow to always impact upon the same location along said contiguous edge so that said concentrated steel flow is always divided into substantially equal molten steel flows within said discharge end;

d) causing each said divided molten steel flow to follow a respective said flow control surface, said flow control surface directing said divided molten steel flow into a spiral molten steel flow along said periphery defining a discharge opening, said spiral molten steel flow perpendicular to said bifurcated port; and e) discharging each said perpendicular spiral molten steel flow into the continuous caster mold.

26. The method recited in claim 25 wherein said tapered bore wall section includes a) a first tapered bore wall section angled toward a vertical bore wall portion at an angle θ; and b) a second tapered bore wall section angled toward said vertical bore wall portion at an angle greater than θ.

27. The method recited in claim 25 wherein each said spiral molten steel flow along said periphery defining a discharge opening provides an equalized pressure zone adjacent each said discharge opening.

28. The method recited in claim 25 wherein said concentrated steel flow divided into said molten steel flow directed into said perpendicular spiral molten steel flows along each said periphery defining a discharge opening creates a high velocity gradient extending from said periphery toward a central axis of each said perpendicular spiral molten steel flow, said high velocity gradient creating an equalized pressure zone adjacent said discharge opening, said equalized pressure zone preventing molten steel back-flow from said continuous caster mold into said bifurcated port.

29. The method recited in claim 25 wherein said concentrated steel flow divided into said molten steel flow directed into said perpendicular spiral molten steel flows along each said periphery defining a discharge opening, creates a high velocity gradient extending from said periphery toward a central axis of each said perpendicular spiral molten steel flow, said high velocity gradient having a reduced volume to surface ratio that provides an increased surface area in the molten steel flow discharged into the continuous caster mold, said increased surface area improving decapitation of energy in said discharged molten steel flow.

30. The invention recited in claim 1 wherein each said spiral molten steel flow along said periphery defining a discharge opening provides an equalized pressure zone adjacent each said discharge opening.

31. The invention recited in claim 1 wherein said concentrated steel flow divided into said molten steel flow directed into said perpendicular spiral molten steel flows along each said periphery defining a discharge opening creates a high velocity gradient extending from said periphery toward a central axis of each said perpendicular spiral molten steel flow, said high velocity gradient creating an equalized pressure zone adjacent said discharge opening, said equalized pressure zone preventing molten steel back-flow from said continuous caster mold into said bifurcated port.

32. The invention recited in claim 1 wherein said concentrated steel flow divided into said molten steel flow directed into said perpendicular spiral molten steel flows along each said periphery defining a discharge opening, creates a high velocity gradient extending from said periphery toward a central axis of each said perpendicular spiral molten steel flow, said high velocity gradient having a reduced volume to surface ratio that provides an increased surface area in the molten steel flow discharged into the continuous caster mold, said increased surface area improving decapitation of energy in said discharged molten steel flow.

33. The invention recited in claim 13 wherein each said spiral molten steel flow along said periphery defining a discharge opening provides an equalized pressure zone adjacent each said discharge opening.

34. The invention recited in claim 13 wherein said concentrated steel flow divided into said molten steel flow directed into said perpendicular spiral molten steel flows along each said periphery defining a discharge opening creates a high velocity gradient extending from said periphery toward a central axis of each said perpendicular spiral molten steel flow, said high velocity gradient creating an equalized pressure zone adjacent said discharge opening, said equalized pressure zone preventing molten steel backflow from said continuous caster mold into said bifurcated port.

35. The invention recited in claim 13 wherein said concentrated steel flow divided into said molten steel flow directed into said perpendicular spiral molten steel flows along each said periphery defining a discharge opening, creates a high velocity gradient extending from said periphery toward a central axis of each said perpendicular spiral molten steel flow, said high velocity gradient having a reduced volume to surface ratio that provides an increased surface area in the molten steel flow discharged into the continuous caster mold, said increased surface area improving decapitation of energy in said discharged molten steel flow.

36. The invention recited in claim 16 wherein said first tapered section and said second tapered section create an increasing high velocity gradient flow of draining molten steel concentrated along said vertical wall segment as the molten steel drains downward through said bore to said discharge end.

37. The invention recited in claim 36 wherein each said spiral molten steel flow along said periphery defining a discharge opening provides an equalized pressure zone adjacent each said discharge opening.

38. The invention recited in claim 36 wherein said concentrated steel flow divided into said molten steel flow directed into said perpendicular spiral molten steel flows along each said periphery defining a discharge opening creates a high velocity gradient extending from said periphery toward a central axis of each said perpendicular spiral molten steel flow, said high velocity gradient creating an equalized pressure zone adjacent said discharge opening, said equalized pressure zone preventing molten steel backflow from said continuous caster mold into said bifurcated port.

39. The invention recited in claim 36 wherein said concentrated steel flow divided into said molten steel flow directed into said perpendicular spiral molten steel flows along each said periphery defining a discharge opening, creates a high velocity gradient extending from said periphery toward a central axis of each said perpendicular spiral molten steel flow, said high velocity gradient having a reduced volume to surface ratio that provides an increased surface area in the molten steel flow discharged into the continuous caster mold, said increased surface area improving decapitation of energy in said discharged molten steel flow.

40. A submerged entry nozzle, comprising:

a) a connection end adapted to attach to a slide gate mechanism;

b) a discharge end including a bifurcated port;

c) a tapered bore extending between said connection end and said discharge end; and d) a flow control structure positioned within the discharge end, said flow control structure including divergent flow control surfaces extending downward along opposite sides of a contiguous edge, each downwardly extending divergent flow control surface flaring in an outward direction toward a respective periphery that defines the bifurcated port and communicating therewith so that when a molten steel stream drained through said tapered bore impacts upon said flow control structure, said molten steel stream is divided into two molten steel streams within said discharge end, whereby each said divided molten steel stream is forced into a oath, by one of said downwardly extending divergent flow control surfaces, so that said molten steel stream flows along and emulates said periphery that defines said bifurcated port.

* * * * *